US007352137B2

(12) United States Patent
Tabell

(10) Patent No.: US 7,352,137 B2
(45) Date of Patent: Apr. 1, 2008

(54) CONTROLLING COLOR TEMPERATURE OF LIGHTING FIXTURE

(75) Inventor: Jari Tabell, Lahti (FI)

(73) Assignee: Teknoware OY, Lahti (FI)

( * ) Notice: Subject to any disclaimer, the term of this patent is extended or adjusted under 35 U.S.C. 154(b) by 334 days.

(21) Appl. No.: 10/861,803

(22) Filed: Jun. 4, 2004

(65) Prior Publication Data

US 2004/0264186 A1 Dec. 30, 2004

(30) Foreign Application Priority Data

Jun. 6, 2003 (FI) ..... 20030853

(51) Int. Cl.
*H05B 37/02* (2006.01)

(52) U.S. Cl. ..... 315/291; 315/307; 362/231

(58) Field of Classification Search ..... 315/156, 315/158, 159, 149, 312, 169.1, 169.3, 307, 315/209 R, 245, 291, 302, 320, 360, 362; 250/205; 362/227–231, 240; 307/10.1
See application file for complete search history.

(56) References Cited

U.S. PATENT DOCUMENTS 6,275,167 B1 * 8/2001 Dombrowski et al. . 340/825.57
6,344,641 B1 * 2/2002 Blalock et al. ..... 250/205
6,351,079 B1 * 2/2002 Willis ..... 315/200 A
6,448,550 B1 9/2002 Nishimura ..... 315/312
6,498,440 B2 * 12/2002 Stam et al. ..... 315/291
6,963,175 B2 * 11/2005 Archenhold et al. ..... 315/291
7,014,336 B1 * 3/2006 Ducharme et al. ..... 362/231
2002/0047624 A1 4/2002 Stam et al. ..... 315/291
2002/0048177 A1 4/2002 Rahm et al. ..... 315/291

FOREIGN PATENT DOCUMENTS

EP 1 152 642 A2 11/2001
EP 1 220 578 A2 7/2003
GB 2 346 004 A 7/2000
GB 2346004 A * 7/2000
WO WO 99/30537 6/1999
WO WO 03/015067 A1 2/2003

* cited by examiner

*Primary Examiner*—Thuy V. Tran
*Assistant Examiner*—Jimmy Vu
(74) *Attorney, Agent, or Firm*—Leydig, Voit & Mayer, Ltd.

(57) ABSTRACT

A method for controlling the color temperature of a lighting fixture, and a lighting fixture, whereby the lighting fixture is implemented using differently colored light emitting diodes. The method comprises steps of generating light by differently colored light emitting diodes (R, G, B) and controlling a current (IdR, IdG, IdB) flowing through the differently colored light emitting diodes in order to provide the lighting fixture with a desired color temperature.

6 Claims, 3 Drawing Sheets

CONTROLLING COLOR TEMPERATURE OF LIGHTING FIXTURE

FIELD OF THE INVENTION

The invention relates to controlling the color temperature of a lighting fixture utilizing light emitting diodes as the light source.

DESCRIPTION OF THE PRIOR ART

Solutions are previously known, in which white light emitting diodes are used as the light source of a lighting fixture in order to generate white light. Since the light level of a single light emitting diode, i.e. the light intensity, is relatively low, a large number of light emitting diodes are typically used in a single lighting fixture so as to acquire an adequately high level of light.

A drawback is associated with the known solution mentioned above that the white light emitting diodes are provided with a high color temperature (approximately 6000K), in which case the shade of the white color generated thereby becomes unpleasant in many situations.

Whether a particular shade of white light is unpleasant or not depends in addition to the color temperature of the lighting fixture for instance on the target, from which light is reflected, and on the light level, i.e. the light intensity. In practice, it is therefore impossible to provide a light emitting diode with such a color temperature, the shade of white light generated thereby would suit all required lighting targets and conditions. As regards fluorescent lamps, a solution has been reached, in which several alternative fluorescent lamps are manufactured provided with a mutually different color temperature so that each application could be provided with a fluorescent lamp that produces a shade of white light appropriate for the purpose. However, such a solution is clumsy as far as it results in a situation, in which several alternative fluorescent lamps have to be manufactured in order to find a fluorescent lamp providing an appropriate shade of white for each purpose.

BRIEF DESCRIPTION OF THE INVENTION

It is an object of the present invention to solve the problem explained above and to provide a solution that allows controlling the color temperature of a lighting fixture in order to achieve an appropriate shade of white light when light emitting diodes are used as light sources. This object is achieved with the method according to the accompanying independent claim 1 and the lighting fixture according to the accompanying independent claim 5.

The invention is based on the idea that mixing light generated by differently colored light emitting diodes can be utilized in lighting fixtures using light emitting diodes as light sources in order to achieve a desired shade of white light. This becomes possible since the light emitting diodes are placed sufficiently close to one another so that the light generated by differently colored light emitting diodes can be adequately mixed among each other. Hence, the end result is white light, the shade of which depends on the mutual intensity of the light generated by the differently colored light emitting diodes. Selecting the currents flowing through the differently colored light emitting diodes appropriately allows achieving a desired shade of white light, in other words the color temperature of the lighting fixture can be controlled in accordance with the desires of the user.

The most significant advantage of the solution according to the invention is that using the same light sources, i.e. light emitting diodes, an appropriate shade of white light can case-specifically be achieved. Thus, the need to produce several white light emitting diodes provided with different color temperatures is avoided. In addition, in a particular target the shade of the white color can be changed in accordance with the situation to suit the particular conditions concerned without having to change the light sources, i.e. the light emitting diodes. The invention is applicable to be used for instance in vehicles such as buses, in which the invention can be applied to illuminate interior spaces for instance with spot lights or light lines with an appropriate shade of white light.

The preferred embodiments of the method and the lighting fixture according to the invention are disclosed in the accompanying dependent claims 2 to 4 and 6 to 10.

BRIEF DESCRIPTION OF THE DRAWINGS

In the following the invention will be described in greater detail with reference to the accompanying drawings, in which.

DESCRIPTION OF THE PREFERRED EMBODIMENTS

In accordance with the invention light is generated using differently colored light emitting diodes. Generating light using light emitting diodes has the same meaning as controlling diodes to a conducting state or conducting current through them. Further according to the invention, current flowing through the differently colored light emitting diodes is controlled in order to achieve a desired color temperature for a lighting fixture. The color temperature is set as desired by controlling currents flowing through the light emitting diodes that allow achieving the desired color temperature. How to control the color temperature may vary. An alternative for controlling the color temperature can be implemented so that transistors, whose base control can be used to set the current flowing through the light emitting diodes, are connected in series with the light emitting diodes. Such a solution and the advantages and properties thereof are explained below with reference to FIGS. 1 and 2.

Figure 1:
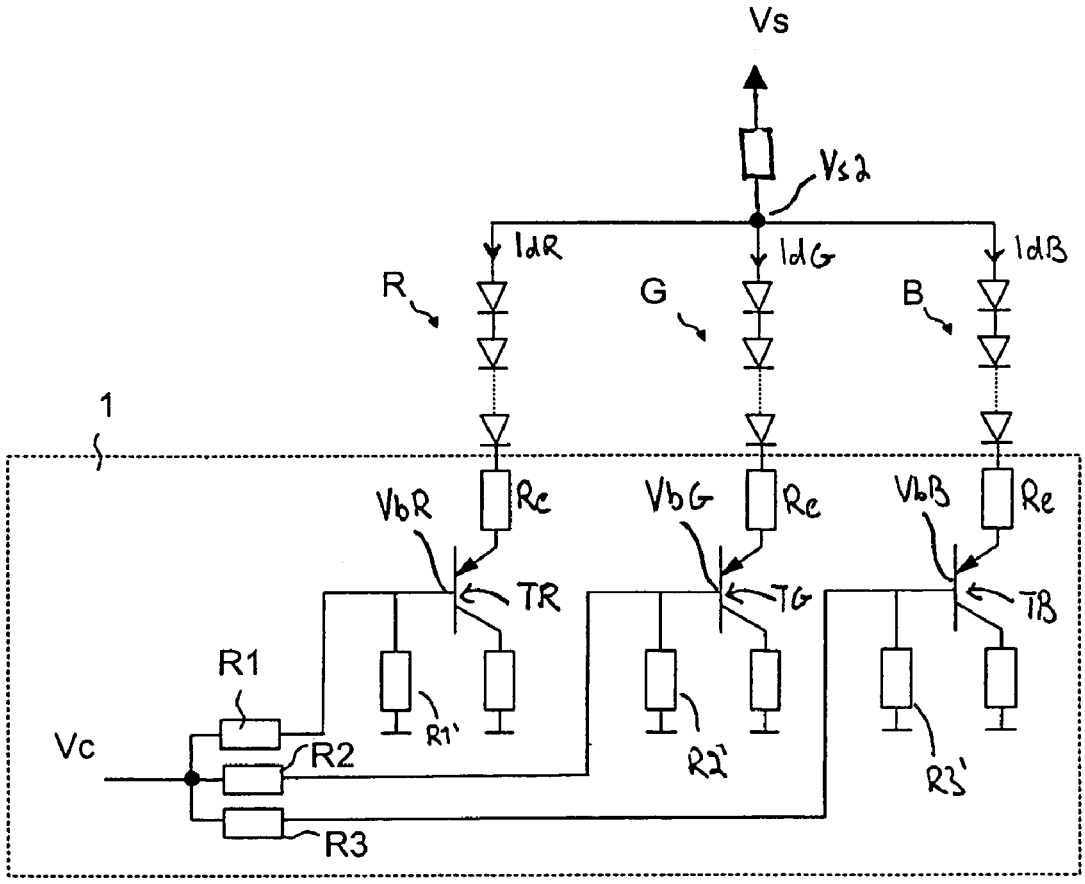
FIG. 1 illustrates a first preferred embodiment of the invention.

FIG. 1 illustrates a first preferred embodiment of the invention. FIG. 1 shows a lighting fixture, in which light is generated by mutually differently colored light emitting diodes R, G and B.

It is assumed by way of example in FIG. 1 that the colors of the light emitting diodes are red, green and blue. Such a combination is preferable in respect that such a color combination can practically be used to provide all the required shades of white light. Alternatively the number of light emitting diodes could for instance be only two, in which case for instance the colors white and red or alternatively white and blue could be concerned. However, in such a case the shades of white light to be provided are clearly more restricted.

Figure 2:
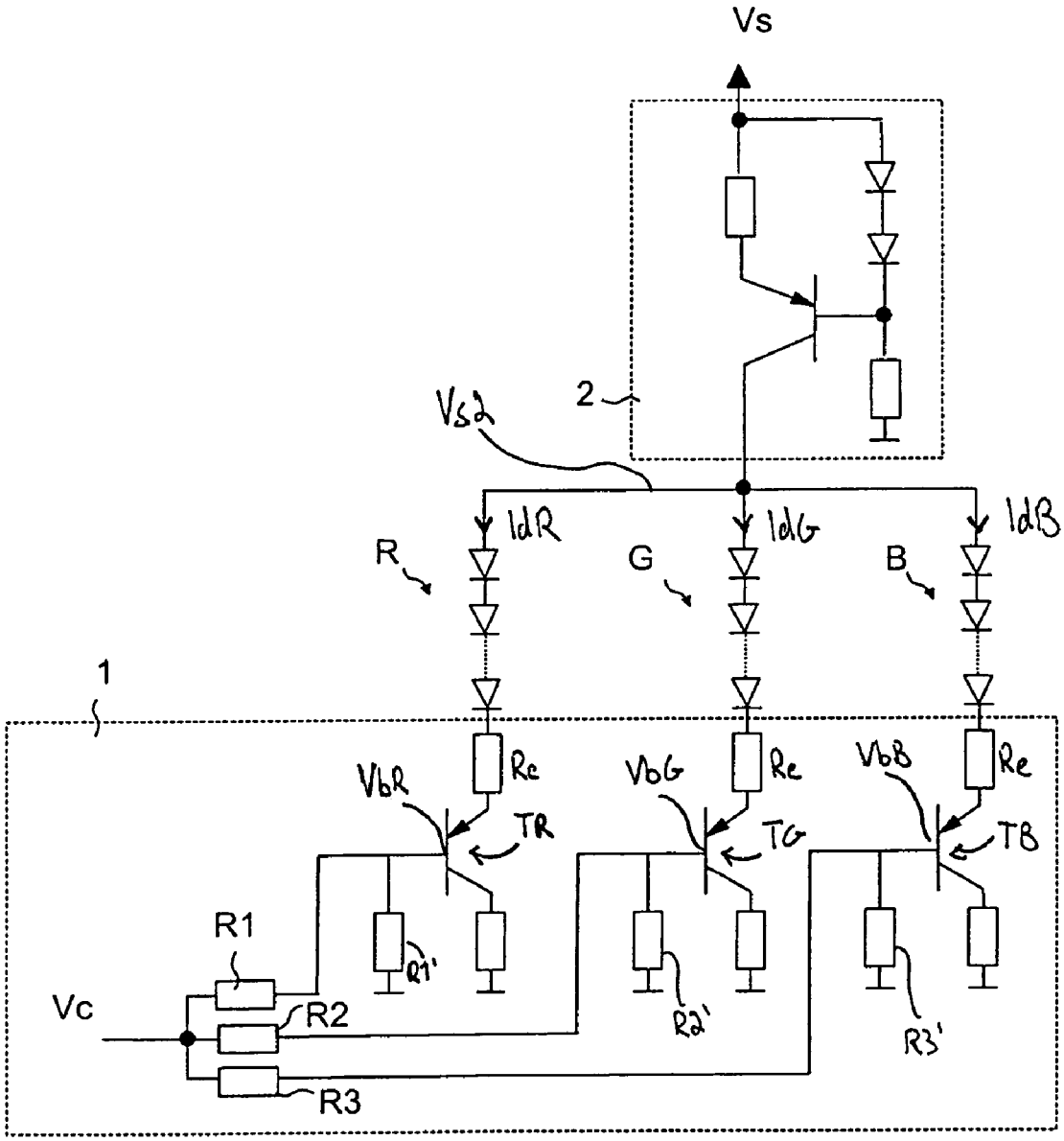
FIG. 2 illustrates a second preferred embodiment of the invention.

In order to achieve different shades of color, in other words controlling the color temperature of the lighting fixture according to the desires of the user, the arrangement shown in FIG. 1 comprises a controller 1, a control voltage Vc conveyed thereof enabling to control the color temperature of the lighting fixture. As shown in FIGS. 1 and 2, the control voltage Vc is conducted at the bases of transistors TR, TG, TB connected as voltage followers through resistors R1, R2, R3. Each one of the transistors TR, TG, TB is connected in series with differently colored light emitting diodes so that the magnitude of a current IdR flowing through red light emitting diodes R is controlled using a transistor TR, the magnitude of a current IdG of green light emitting diodes G using a transistor TG and the magnitude of a current IdB of blue light emitting diodes B correspondingly using a transistor TB. The voltage division provided by the resistors R1, R2, R3 of the controller and by resistors R1', R2', R3 connected in series therewith provide the transistors TR, TG, TB with base voltages VbR, VbG, VbB, the magnitude of which depends on the control voltage and the magnitudes of the resistors R1, R1'; R2, R2'; R3, R3'.

The voltage division formed by the resistors R1, R1'; R2, R2'; R3, R3' connected in series allows controlling the color shade according to the invention. The voltage division is dimensioned so that the control voltage Vc affects the base voltages of the transistors in such a manner that a change in the control voltage provides each transistor with base voltages of different magnitudes, whereby the ratio of currents flowing through the transistors changes and thus also the color of the light generated by the combination of the light emitting diodes changes. The ratios of the resistor divisions can therefore be used to implement the control characteristic of the lighting temperature, along which the lighting changes when the control voltage is changed.

The function of the coupling and the invention shown in FIG. 1 is explained in the following by means of a simplified example. In the embodiment shown in FIG. 1, light emitting diode chains R, G, B are supplied with a supply voltage Vs.

The following calculation has been made assuming that:

the values of all other resistors except R1, R2 and R3 are 1 kΩ;

the common supply voltage Vs of the light emitting diode chains is a standard 13 V;

the excess voltage VD of the light emitting diodes in each light emitting diode chain (R, G, B) is 3.0 V;

the base emitter voltage Vbe of the transistors is 0.6 V;

R1=5 kΩ;

R2=3 kΩ;

R3=1 kΩ;

The base voltages Vb of the transistors are obtained with these initial values as a function of the control voltage Vc:

$$VbR=Vc\times 1k/(1k+R1)=Vc\times 0.17$$

$$VbG=Vc\times 1k/(1k+R2)=Vc\times 0.25$$

$$VbB=Vc\times 1k/(1k+R3)=Vc\times 0.5$$

The base voltages then obtain the following values using the different values of the control voltage Vc:

| | VbR | VbG | VbB |
|---|---|---|---|
| Vc = 0 V: | 0 V | 0 V | 0 V |
| Vc = 5 V: | 0.85 V | 1.25 V | 2.5 V |
| Vc = 10 V: | 1.7 V | 2.5 V | 5.0 V |

A current Id of each light emitting diode chain can thus be stated as the function of the base voltage Vb of the transistor in the light emitting diode chain in the following form:

$$\begin{aligned} Id &= URe/Re \\ &= (Vs - VD - Vb - Vbe)/Re \\ &= (13\text{ V} - 3\text{ V} - Vb - 0.6\text{ V})/1k \\ &= (9.4\text{ V} - Vb)/1k \end{aligned}$$

where Re is the resistor between the emitter of the transistor and the light emitting diode chain and URe is the voltage drop above this resistor.

Thus the different control voltage values Vc are used to obtain the currents of the light emitting diode chain

| | IdR | IdG | IdB |
|---|---|---|---|
| Vc = 0 V: | 9.4 mA | 9.4 mA | 9.4 mA |
| Vc = 5 V: | 8.55 mA | 8.15 mA | 6.9 mA |
| Vc = 10 V: | 7.7 mA | 6.9 mA | 4.4 mA |

Figure 3:
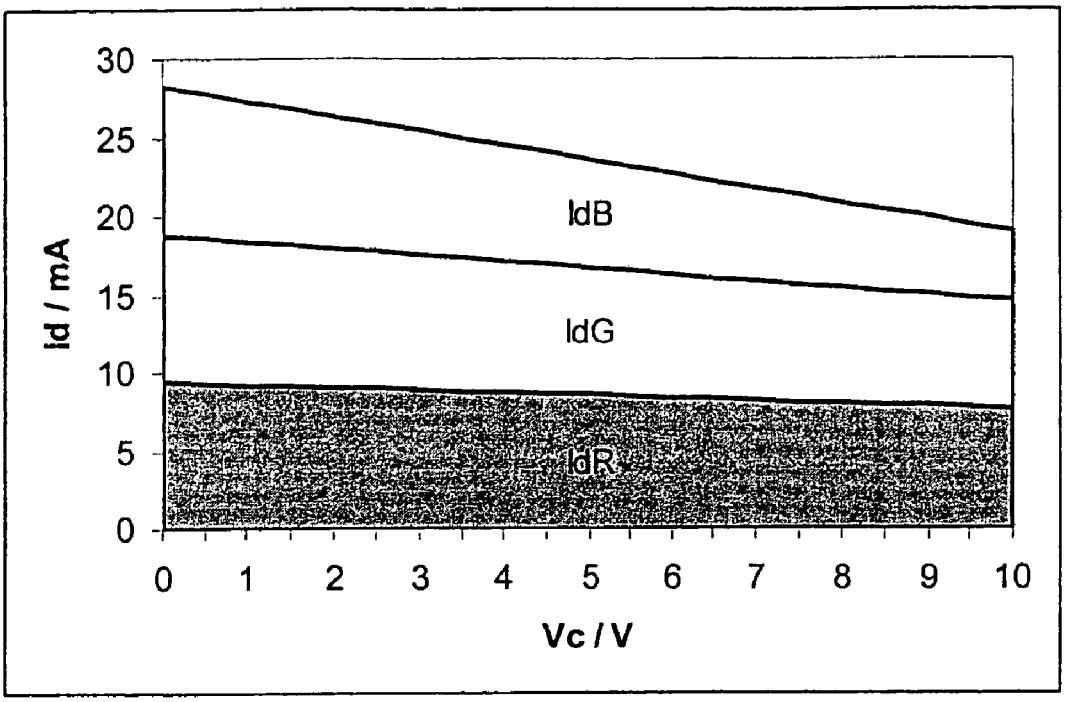
FIG. 3 is a graphical representation of an exemplary calculation associated with the embodiment shown in FIG. 1.

The above presented exemplary dimensionings allow reducing the current of the blue LED chain B the most when the control voltage Vs is increased, whereby the shade of the light to be generated by the lighting fixture of the invention changes more towards the red. Thus combined with the embodiment of FIG. 1 the color temperature decreases while the total light current is reduced. The embodiment shown in FIG. 1 thus enables to provide a lighting fixture, whose color temperature is reduced when the lighting fixture is dimmed in order to increase the enjoyability of the generated light. FIG. 3 illustrates the change in currents according to the embodiment shown in FIG. 1 by means of the above exemplary calculation. The Figure clearly shows that as the control voltage increases, the current IdB flowing through the blue light emitting diode chain B is reduced the most. At the same time the total current is reduced, meaning that the amount of light to be generated decreases.

Figure 4:
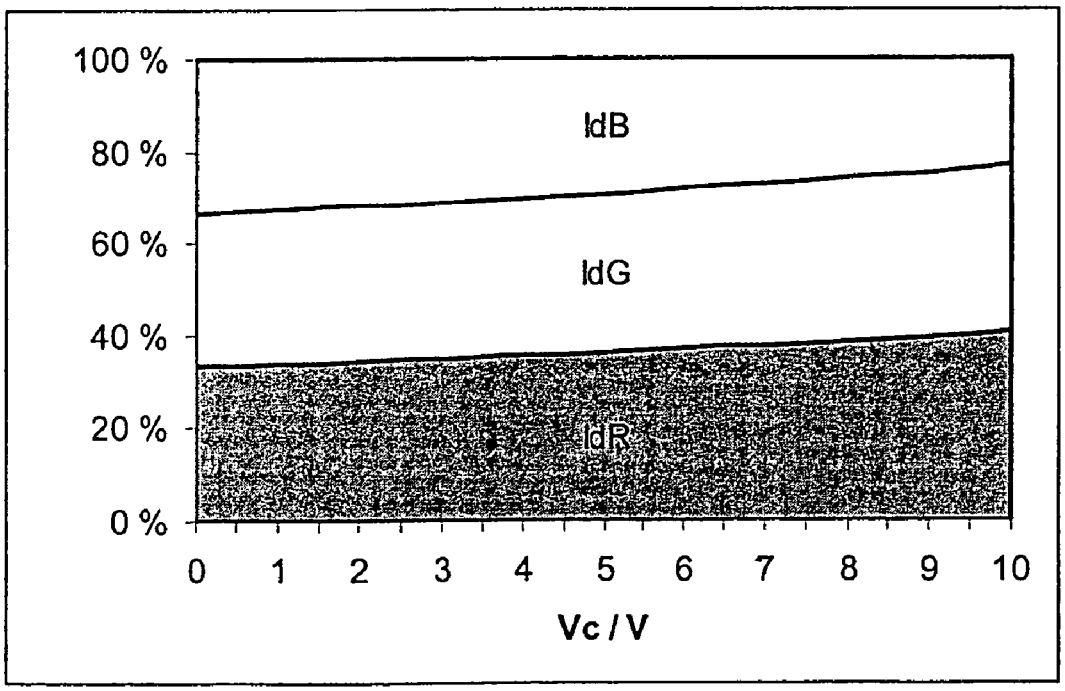
FIG. 4 is a graphical representation of an exemplary calculation associated with the embodiment shown in FIG. 2.

An embodiment is shown in FIG. 2, in which a constant-current regulator 2 is added in comparison with the embodiment shown in FIG. 1. What is achieved with the constant-current regulator is that the total current of all the light emitting diode chains is not reduced, but remains the same irrespective of the change occurring in the control voltage Vc. FIG. 4 shows a diagram based on the above calculation and the embodiment shown in FIG. 2, whereby the supply voltage Vs is replaced with a voltage Vs2 after the constant-current regulator 2 in the calculation. The diagram clearly shows the effect of the control voltage as an increase in the portion of the red R light emitting diode chain current and correspondingly as a decrease in the blue B light emitting diode chain current. This embodiment implemented using the constant current regulator allows carrying out the change in color temperature without altering the magnitude of the total light current. Thus, the level of lighting generated by the lighting fixture according to the invention remains substantially constant.

The voltage dividers implemented using the resistors R1, R1'; R2, R2'; r3, R3' of the controller 1 shown in the embodiments of FIG. 1 and 2 are dimensioned so that the desired change in the currents of the differently colored light emitting diode chains can be achieved. The dimensionings of the resistors can thus be used to affect how much each color has to be changed in relation to the other colors.

For clarity, FIGS. 1 and 2 show only a few color diodes of each color R, G, B. in practice, when a lighting fixture is implemented by means of light emitting diodes the total number of diodes and thus also the number of diodes having the same color is significantly larger in order to obtain an adequate light level with the light emitting diodes. Such light emitting diodes are then controlled using a mutual controller. When applying the invention in practice, dozens of light emitting diodes can for instance be piled on the same circuit board, which light emitting diodes are encapsulated in one fluorescent lamp, whose light beam is transmitted to the environment for instance through a lens. Alternatively the invention can be applied for instance in long light lines to be utilized in vehicles, such as buses, in which case a single light line may comprise up to hundreds of light emitting diodes.

It is to be understood that the above description and the drawings associated therewith are merely intended to illustrate the present invention. Different variations and modifications of the invention will be apparent to those skilled in the art without having to deviate from the scope of the invention shown in the accompanying claims.

The invention claimed is:

1. A method for controlling the color temperature of a lighting fixture, wherein the lighting fixture is implemented using differently colored light emitting diodes, the method comprising the steps of generating light using the differently colored light emitting diodes, and controlling a respective current flowing through the differently colored light emitting diodes, wherein the step of controlling the current flowing through the light emitting diodes comprises the steps of:

generating a control voltage in order to control the light emitting diodes, generating from the control voltage separate base voltages to each of the differently colored light emitting diodes, and controlling each differently colored light emitting diode proportionally to the control voltage using the base voltages by controlling the current flowing through the differently colored light emitting diodes in order to provide the lighting fixture with a desired color temperature.

2. The method as claimed in claim 1, wherein the method further comprises a step of controlling the sum of the currents of the differently colored light emitting diodes to be substantially constant.

3. A lighting fixture comprising light sources formed of light emitting diodes and a controller in order to control the lighting generated by the light sources, the light emitting diodes of the lighting fixtures comprising light emitting diodes of at least two different colors, the controller being arranged to control the light intensity generated by the differently colored light emitting diodes in order to control the color temperature of the lighting fixture, the controller comprising means for controlling a respective current flowing through each differently colored light emitting diode in response to a control voltage, said means for controlling the respective current flowing through each differently colored light emitting diode comprising transistors connected in series with the light emitting diodes of each color and a resistance coupling defining a base voltage for each transistor in response to the control voltage.

4. The lighting fixture as claimed in claim 3, wherein the lighting fixture further comprises a constant-current regulator in order to maintain the light level generated by the light emitting diodes substantially constant when controlling the color temperature of the lighting fixture.

5. The lighting fixture as claimed in claim 3, wherein said controller is arranged to control the color temperature of the lighting fixture in response to the light level control so that the controller sets the color temperature lower when the light level is set lower and sets the color temperature higher when the light level is set higher.

6. The lighting fixture as claimed in claim 3, wherein the lighting fixture comprises red, green and blue light emitting diodes.

* * * * *